US007793483B2

(12) United States Patent
Stanchfield et al.

(10) Patent No.: US 7,793,483 B2
(45) Date of Patent: Sep. 14, 2010

(54) VENTILATED FLOOR MOLDINGS

(75) Inventors: Oliver Stanchfield, Garner, NC (US); Sven Kornfalt, Malmo (SE); Roland Larsson, Apex, NC (US); William T. Pierce, Smithfield, NC (US); Sabad La Serna, Raleigh, NC (US); Patrick George Smith, Raleigh, NC (US); Wayne Robert Johnston, San Marcos, CA (US)

(73) Assignee: Pergo AG, Baar (CH)

( * ) Notice: Subject to any disclaimer, the term of this patent is extended or adjusted under 35 U.S.C. 154(b) by 0 days.

(21) Appl. No.: 11/522,535

(22) Filed: Sep. 18, 2006

(65) Prior Publication Data

US 2008/0066419 A1 Mar. 20, 2008

(51) Int. Cl.
*E04C 2/38* (2006.01)

(52) U.S. Cl. ..... 52/716.1; 52/717.02; 52/717.03; 52/717.04; 52/717.05; 52/717.06; 52/302.1; 52/302.3

(58) Field of Classification Search ..... 52/716.1, 52/717.02–717.06, 716.2, 716.8, 311.1, 311.2, 52/287.1, 288.1, 302.1, 302.3, 169.5
See application file for complete search history.

(56) References Cited

U.S. PATENT DOCUMENTS

| | | | | | |
|---|---|---|---|---|---|
| 2,703,002 | A | * | 3/1955 | Suskind | 52/302.3 |
| 3,222,837 | A | * | 12/1965 | Daley | 52/287.1 |
| 3,273,297 | A | | 9/1966 | Wehe, Jr. | |
| 3,304,672 | A | | 2/1967 | Bakke | |
| 4,075,800 | A | | 2/1978 | Molick | |
| 4,109,434 | A | * | 8/1978 | Katzin | 52/288.1 |
| 4,265,064 | A | | 5/1981 | Parezo | |
| 4,333,281 | A | | 6/1982 | Scarfone | |
| 4,520,605 | A | * | 6/1985 | Budd | 52/287.1 |
| 4,601,144 | A | * | 7/1986 | Tinti | 52/211 |
| 4,660,333 | A | | 4/1987 | Romer | |
| 4,719,333 | A | | 1/1988 | White | |
| 4,719,733 | A | * | 1/1988 | Seles | 52/287.1 |
| 4,760,681 | A | * | 8/1988 | Harrison | 52/716.2 |
| 4,869,032 | A | * | 9/1989 | Geske | 52/169.5 |
| 4,879,851 | A | | 11/1989 | Boccia | |
| 4,905,438 | A | * | 3/1990 | Brennan | 52/288.1 |
| 5,044,821 | A | * | 9/1991 | Johnsen | 405/50 |
| 5,450,698 | A | | 9/1995 | Hoopengardner | |

(Continued)

FOREIGN PATENT DOCUMENTS

| | | |
|---|---|---|
| WO | 9731775 | 9/1997 |

(Continued)

OTHER PUBLICATIONS

System Platon, May 4, Erst. Apr. 2, Isola.

(Continued)

*Primary Examiner*—Richard E Chilcot, Jr.
*Assistant Examiner*—Mark R Wendell
(74) *Attorney, Agent, or Firm*—Novak Druce & Quigg LLP

(57) ABSTRACT

A ventilated quarter round molding or shoe molding can be used, in combination with a water impervious underlayment to dissipate water vapor which is often generated from sub-floors. Such water vapor can damage certain flooring, and the invention allows for the installation of devices to limit or eliminate such damage without significant cost.

14 Claims, 4 Drawing Sheets

U.S. PATENT DOCUMENTS

| | | | | |
|---|---|---|---|---|
| 5,501,044 | A | 3/1996 | Janesky | |
| 5,771,643 | A * | 6/1998 | Parker | 52/169.5 |
| 5,794,388 | A * | 8/1998 | Jackman | 52/169.5 |
| 5,950,370 | A * | 9/1999 | Peck | 52/35 |
| 6,106,654 | A | 8/2000 | Velin | |
| 6,282,855 | B1 * | 9/2001 | Shipton | 52/287.1 |
| 6,287,046 | B1 | 9/2001 | Neuhofer | |
| 6,401,418 | B1 * | 6/2002 | Senn et al. | 52/506.01 |
| 6,517,935 | B1 | 2/2003 | Kornfalt | |
| 6,805,951 | B2 | 10/2004 | Kornfalt | |
| 6,860,074 | B2 | 3/2005 | Stanchfield | |
| D508,332 | S | 8/2005 | Julton | |
| 6,991,830 | B1 | 1/2006 | Hansson | |
| 7,003,364 | B1 | 2/2006 | Hansson | |
| 7,029,741 | B2 | 4/2006 | Sjoberg | |
| 7,065,931 | B2 | 6/2006 | Kornfalt | |
| 2002/0014046 | A1 | 2/2002 | Korn | |
| 2005/0166526 | A1 * | 8/2005 | Stanchfield | 52/716.1 |
| 2005/0204653 | A1 | 9/2005 | Matthews | |

FOREIGN PATENT DOCUMENTS

| | | |
|---|---|---|
| WO | 9731776 | 9/1997 |
| WO | 2005116364 | 12/2005 |

OTHER PUBLICATIONS

U.S. Appl. No. 09/964,838, filed Sep. 28, 2001.
U.S. Appl. No. 10/440,317, filed May 19, 2003.

* cited by examiner

VENTILATED FLOOR MOLDINGS

BACKGROUND

1. Field of the Invention

The invention is a ventilated molding which, when with or without a ventilated underlay, allows for moisture to be dissipated without damaging the flooring installed over the underlay.

2. Background of the Invention

Water vapor is emitted from concrete pads, often used as floors (or subfloors) in construction of homes, shopping malls, restaurants, retail establishments, warehouses, office buildings and other static structures. The water vapor can damage finished wood based flooring material. The water vapor can damage finished wood based flooring such as hardwood and laminate flooring that is installed over concrete sub floors. It can also damage other flooring products and promote the growth of mold and mildew.

When these floors are installed as a floating floor system over subfloors made of concrete or other materials, a vapor retarder or vapor barrier is often placed between the finished floor and the concrete sub floor to protect the finished flooring. The vapor retarder/barrier diverts most of the water vapor emitted from the concrete sub floor to the perimeter of the finished floor where it can disperse without damaging the finished flooring.

The vapor retarder/barrier is most frequently seen in the form of a polyethylene film, although it can be made of other materials as well. These retarders/barriers are typically constructed as a flat sheet of material with seams overlapped or taped. Some of these retarders/barriers are made with an irregular surface, such as raised features that allow easier movement of air and water vapor between the retarder/barrier and the concrete sub floor to the perimeter of the finished flooring.

All vapor retarders, as opposed to vapor barriers, allow the passage of some amount of water vapor. Small or larger amounts of water vapor can pass through the retarders as they are also diverting the majority of the water vapor to the perimeter of the finished flooring installation. When the building and the building site has been constructed to acceptable building codes, these vapor retarders often protect the finished flooring from normal water vapor emissions from concrete or other permeable sub floors; however, should the building's condition change, the building site change or is not constructed to protect the building from excessive moisture exposure, such as seasonal variations, poor repair or water drainage from the building site, then under these conditions the finished flooring can be damaged. Such damage can also occur when excessive water vapor is emitted from the concrete or other permeable sub floor. Water vapor passing through the vapor retarder, over time, will accumulate between the vapor retarder and the underside of the finished flooring, that water vapor is absorbed by the finished flooring causing the joints to swell and often causing a warped condition in flooring planks.

Barriers, in contrast, do not permit the passage of water vapor, but the tape used to joint these barriers together at their seams is often the weakest link. Over time such tapes, exposed to excessive moisture, can allow some passage of water vapor. In order to reduce excessive water vapor that could accumulate between vapor retarders and vapor barriers and the concrete sub floors, elaborate ventilation systems have been devised to vent the water vapor more quickly from beneath the retarder/barrier.

These ventilation systems use wall base molding and other materials. These systems are expensive to make and to install. Typically when a home is having its floor covering replaced all wall base molding usually remains fastened to the walls because it matches existing wall base throughout the home and replacing the wall base is not only expensive, it may also require refinishing the walls where the wall base is attached. When a finished molding is required at the edge of finished flooring where it meets the wall base, a quarter round or base shoe molding is typically installed. This molding is less expensive and easier to install than a wall base.

SUMMARY OF THE INVENTION

In order to solve the problems of conventional systems, the present inventors have developed a ventilation system for water vapor to easily escape from beneath a vapor retarder/barrier that rests on the surface of a sub floor, that is easy to install, requires less expense and building materials and would be a desirable improvement over existing systems.

For example, when a home has wall base in a number of rooms, and such wall base is similar (typically in both shape and color), and one desires to replace the flooring in less than all of the rooms, the present invention allows for the dissipation of water vapor generated from the subfloor without being forced to replace the wall base in the room.

An improvement over existing systems could include a ventilation system that uses ventilation materials with quarter round/base shoe molding or simply a ventilated quarter round/base shoe molding to allow the escape of water vapor that accumulates between a vapor retarder/barrier and a concrete sub floor. Using such as system reduces labor and material expense producing the same effect as more elaborate and expensive systems.

The ventilation material may, in some instances, be used as part of the molding fastening system or may be a part of the fastening system.

The outward-facing surface of the ventilation system may be formed as a single, unitary, monolithic surface. This outward-facing surface may be treated, for example, with a laminate or a paper, such as a decor, impregnated with a resin, in order to increase its aesthetic value, or blend, to match or contrast with the adjacent flooring and/or walls. Optionally, the outward facing surface has incorporated therein at least one material to increase its abrasion resistance, such as hard particles of silica, ceramics, alumina, diamond, silicon nitride, silicon carbide and similar hard particles, preferably having a Moh's hardness of at least approximately 6. This outward-facing surface may also be covered with other types of coverings, such as foils (such as paper or thermoplastic foils), paints, wood veneer, ceramic (such as tiles), metal (e.g., copper, brass, aluminum, steel, galvanized metals, or other alloys), vinyl or a variety of other decorative elements. In one embodiment, the covering of the outward-facing surface matches the color/pattern/design of the adjacent flooring element, e.g., the color/pattern/design on the flooring element can simply be copied onto the surface, or the color/pattern/design may be positioned on the surface, such that the color/pattern/design continues without interruption when assembled adjacent the flooring element.

The interior of the ventilation system is generally formed from wood or wood-based materials including fiberboard, such as high density fiberboard (HDF) or medium density fiberboard (MDF); plastics, flaxboard, gypsum, high density reinforced plaster, or other structural material, such as metals or composite.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

Figure 1:
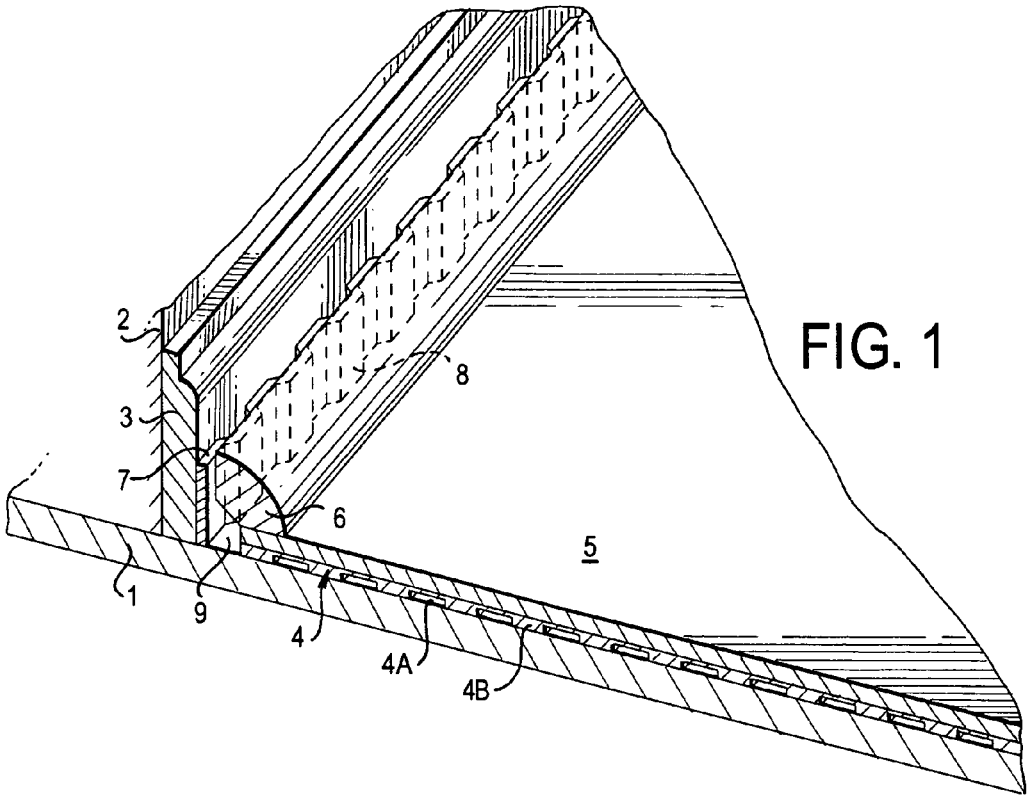
FIG. 1 shows a ventilated quarter round according to the invention in an installed condition.

As used throughout the specification and claims, a "laminate" is a multilayered structure, formed from at least a décor layer and an overlay. Laminate flooring is typically a rigid floor covering with a surface layer of one or more thin sheets of a fibrous material (usually paper), impregnated with aminoplastic thermosetting resins (usually melamine). These sheets are generally either pressed as such, for example high-pressure laminate (HPL), compact laminate (CPL) and direct laminate (DL), and in the case of HPL or CPL bonded on a substrate, or in the case of DPL directly pressed on a substrate.

Typically, the décor layer is a monochromatic or patterned paper sheet, impregnated with a melamine-formaldehyde resin. The pattern can be of any image, but is most often a natural wood or stone pattern. However, it is within the scope of the invention to utilize a completely unique "fantasy" pattern derived from a photograph, a drawing, painting or any other image (in analog or digital form), such as described by U.S. Pat. No. 7,003,364, herein incorporated by reference in its entirety. In most embodiments, the décor layer includes a paper sheet, such as Kraft paper, onto which the image/pattern/décor is printed. However, it is within the scope of the invention to combine the décor layer with the core, by, for example, printing the image/pattern/décor directly onto the core itself.

The overlay is conventionally an abrasion resistant sheet formed from alpha-cellulose and impregnated with a thermosetting resin. Preferably, the thermosetting resin is a melamine-formaldehyde resin. In order to provide scratch and/or abrasion resistance, the overlay may be provided with hard particles (i.e., particles having a Moh's hardness of at least approximately 3, preferably at least about 6, such as silicon carbide, alumina, and diamond) having an average particle size between approximately 30-90 μm, and are evenly distributed to a loading of 2-20 g/m$^2$. In order to provide scratch resistance to the product, smaller hard particles, e.g., having an average particle size of between 1-15 μm, and evenly distributed to a loading of 1-15 g/m$^2$, can be used, as described by U.S. Pat. No. 6,106,654, incorporated herein by reference in its entirety. Even greater abrasion/scratch resistance can be achieved by utilizing multiple overlays, such as described by U.S. Pat. No. 4,940,503, incorporated herein by reference in its entirety.

Typically, the laminate is affixed to a core. Typical core materials include metals (such as aluminum, copper, steel, and various alloys) and wood based materials, such as solid wood, wood veneer, oriented strandboard, plywood, fiberboard (e.g., high density fiberboard (HDF) and medium density fiberboard (MDF)); plastics (e.g., extruded or molded, thermoplastic or thermosetting), flaxboard, gypsum, high density reinforced plaster, other cellulosic and structural materials, or composites.

As is known in the art, quarter round moldings and shoe moldings are designed to be utilized above a subfloor 1, in the area where a wall 2 is partly covered by a wall base molding 3. Typically, a layer 4 is placed between the subfloor 1 and a flooring element 5, with a quarter round molding 6 covering the joint between the flooring element 5 and the wall base molding 3. In accordance with the invention, quarter round 6 is provided with means for dissipating water vapor which develops in the area of the wall base.

The quarter round 6 is typically any known quarter round molding, having been modified to include the ventilation of the invention. For example, the quarter round 6 typically has an inner structure, or core which can be formed from one or more of a wood based material, plastics, flaxboard, strandboard, gypsum, high density fiber reinforced plaster, or metal, composites, or other natural or synthetic material such as cork, or any additional material, such as described in U.S. Pat. No. 6,860,074, herein incorporated by reference in its entirety. Preferred plastics include extrudable and/or moldable thermosetting and thermoplastic resins, the latter including high density olefins and polyvinylchloride (PVC). As is known in the art, quarter round moldings generally include a curved outer face, often defining an arc segment of 90°, with adjacent perpendicular faces, such that when the quarter round is installed at a joint between a floor and a wall, the curved outer surface extends from the wall to the floor to aesthetically hide the joint.

The decorative outer face of the quarter round 6 can have a variety of finishes, such as varnishes, lacquers, paints, polyurethane, hard surfaces (optionally containing hard particles, to increase the durability, e.g., abrasion and scratch resistance, of the surface materials), such as laminates (such as taught by U.S. Pat. No. 7,065,931, herein incorporated by reference in its entirety), or hardwood flooring finishes, veneers, foils, stainable papers, or digital printing or other flooring materials, such as vinyl, metal, composites or plastics. It is additionally within the scope of the invention to provide the decorative outer face of quarter round 6 with ceramic or wood tiles, as taught by U.S. Pat. No. 6,860,074. Typical laminates which can be used are those taught by U.S. Pat. No. 6,517,935 (herein incorporated by reference in its entirety), including monochromatic or patterned (including random) décor sheets which may or may not be impregnated with a thermosetting resin, and a cellulosic overlay paper, such as one made from alpha-cellulose, which also may or may not be impregnated with a resin. Other laminates include ones in which the overlay is eliminated, and may be substituted by a polymer containing cellulosic particles, evenly or randomly distributed throughout a (typically otherwise clear) resin. The outer surface may be a conventional laminate, such as a high pressure laminate (HPL), direct laminate (DL), compact laminate (CPL) or a post-formed laminate (PFL) (as described in U.S. application Ser. No. 08/817,391, herein incorporated by reference in its entirety); a foil; a print, such as a photograph or a digitally generated image; or a liquid coating including, for example, aluminum oxide. Thus, in the event natural wood or wood veneer is not selected as the material, the appearance of wood may be simulated by coating the decorative outer surface with a laminate having a decor that simulates wood. Alternatively, the decor can simulate marble, ceramic, terrazzo, stone, brick, inlays, or even fantasy patterns.

In a preferred embodiment, the outer face of quarter round 6 includes a laminate formed from a thermosetting resin, having a décor sheet, optionally an overlay sheet (with or without cellulosic fibers atop or therein) and hard particles therein in order to impart an abrasion resistance thereto, which is affixed or joined to the remainder of the quarter round 6 in a high-pressure laminate process step. Such laminate may be affixed as described by U.S. Pat. No. 6,805,951, herein incorporated by reference in its entirety. The outer face can be other finishing materials such as thermoplastic containing laminates, wood veneers, thermosetting polymers, such as melamine or phenolic resins, thermoplastic polymers such as olefins, foils (such as thermosetting, thermoplastic, paper or metal foils), optionally impregnated with or without hard particles, polyesters, vinyls, liquid coatings, metals (such as sheets or strips), or combinations thereof. For example, the outer face can include multiple elements, as described herein. It is additionally considered within the scope of the invention to affix a material to the outer face during a direct lamination step, as is known in the art.

The specific décor can be selected to enhance the appearance of the surfaces which will be adjacent to quarter round 6 when installed. Such enhancement can be accomplished by matching exactly the visual pattern to that of the adjacent surface, or by contrasting the patterns, for example, such that when installed, a visual pattern extends from a flooring element (wall base or wall) onto and possibly completely across the molding, as described by U.S. application Ser. No. 09/964,838, filed Sep. 28, 2001, herein incorporated by reference in its entirety.

The quarter round 6 typically has durability rating. As defined by the European Producers of Laminate Flooring, such products can have an abrasion resistance rating of anywhere from AC1 to AC5. Typical abrasion resistances are >300 cycles, >400 cycles, >500 cycles, at least 900 cycles (AC1), at least 1800 cycles (AC2), at least 2500 cycles (AC3), at least 4000 cycles (AC4) and at least 6500 cycles (AC5), as measured by European Standard EN 13329 (Annex E). Typical products according to the invention can also have impact resistance ratings of IC1, IC2 or IC3, as measured by European Standard EN 13329.

Moreover, it is possible to provide a texture which enhances the pattern of the underlying paper sheet. Such texturing can be created to be "in register" with, offset from, or to contrast with the image of the paper sheet. Such texturing may be created by physical pressing, e.g., embossing (as taught by U.S. Application Ser. No. 10/440,317 (filed May 19, 2003), U.S. Pat. No. 7,003,364, and WO9731775 and WO9731776, each of which is herein incorporated by reference in its entirety) or chemically created (as taught by U.S. Pat. No. 6,991,830, herein incorporated by reference in its entirety). The texture can be selected to enhance (e.g., match or contrast with) any texture of adjacent surfaces. The texture may also be provided such that features of the texture extend from a flooring element (or wall base or wall) onto and possibly completely across the molding, which texture may, or may not coincide with the underlying décor.

As is shown in FIG. 1, the quarter round molding 6 may be provided with a ventilating or spacing material 8 what allows for the flow of air and water vapor from beneath the layer 4. The spacing material can be placed in or over a gap 9 between the layer 4 and the wall base 3, which gap 9 is typically in fluid communication with the space between the flooring element 5 and the wall base 3.

In order to direct the flow of vapor to the quarter round 6, the layer 4 preferably defines channels 4A extending along the lower face of layer 4. Such channels 4A may be formed from circular, rectangular, rhomboid, or other shaped studs 4B, arranged randomly or in a, for example, grid pattern. As an alternative, the lower face of layer 4 may simply be provided with the channels 4A being cut other otherwise formed in the lower face of layer 4A. A preferred layer 4 is PLATON FLOOR, available from Isola AS of Notodden, Norway. Other suitable layers include the underlay sheet described by U.S. Design Pat. No. 508,332. Typical materials for layer 4 include plastics, such as olefins (e.g., high and low density polyethylene), metals (preferably in sheet form, such as aluminum or aluminum alloys), woven and non woven fabrics, or other material which can hinder or prohibit vapors from passing therethrough. Preferably, spacing material 8 is in the form of thin strips or rolls, which are placed vertically into the subfloor 1 and layer 4, resting against the wall base 3 (or wall 2 when a wall base 3 is not used).

Figure 9:
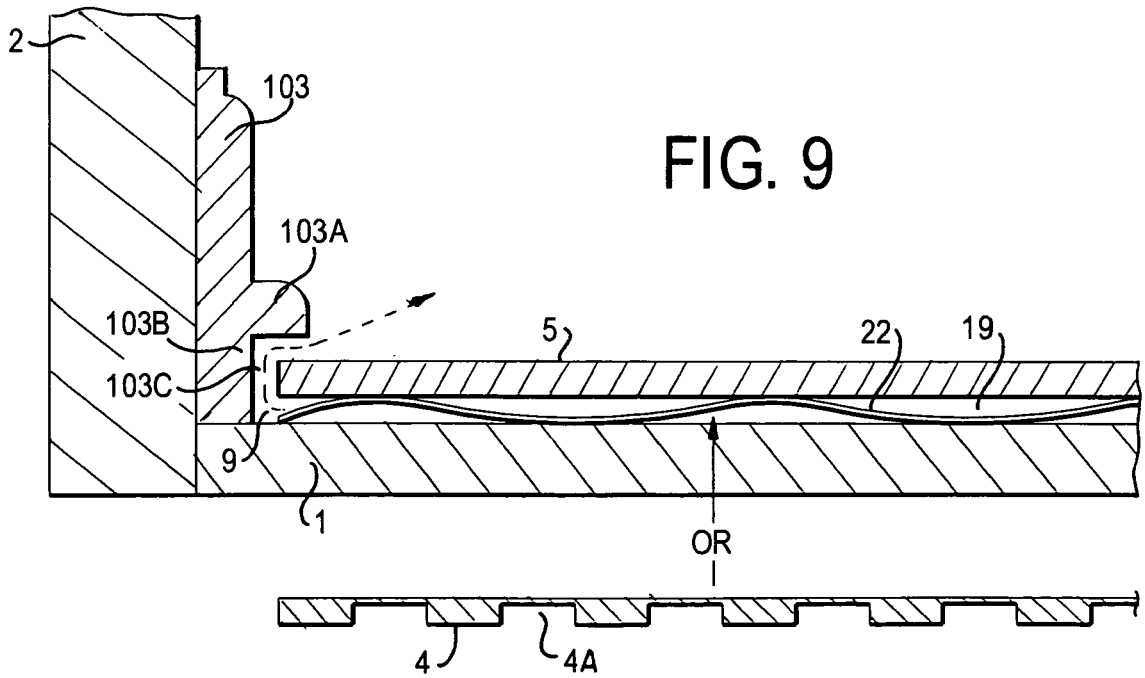
FIGS. 9 and 10 illustrate an embodiment where a quarter round molding is combined with a wall base.

As is shown in FIG. 9, the layer 4 can also take the form of an unattached underlayment 19, having no studs or channels therein. Such an underlayment is typically formed from a polyolefin (such a polyethylene) sheet or other material in a roll or sheet form to function as a vapor barrier.

The spacing material 8 can be any material which allows water vapor to pass from channels 4A to the room. Typical materials include materials which have physical spaces, e.g., meshes, or materials capable of absorbing water vapor and directing the vapor through the material to the room. Such water absorbing materials preferably direct water vapor by wicking and/or capillary action and may include cotton or other cellulosic substances.

Once the spacing material 8 is positioned, the quarter round 6 is typically placed over the space 9, between flooring element 5 and the wall base 3 (or wall 2), and is installed against spacing material 8 and the wall base 3 (or wall). The quarter round 6 can be secured to the wall base 3 with any known affixing means, e.g., nails, screws, tacks, tracks, clips, fresh glue, pre-applied glue (such as one or two-part microencapsulated systems (as discussed by U.S. Pat. No. 7,029,741, herein incorporated by reference in its entirety)), or any combination thereof.

Due to the configuration of spacing material 8 and the quarter round 6 of the invention, the spacing material 8 creates spaces 7 between the wall base 3 (or wall 2) and the quarter round 6 for water vapor to escape from beneath layer 3 and the subfloor 1.

Figure 2:
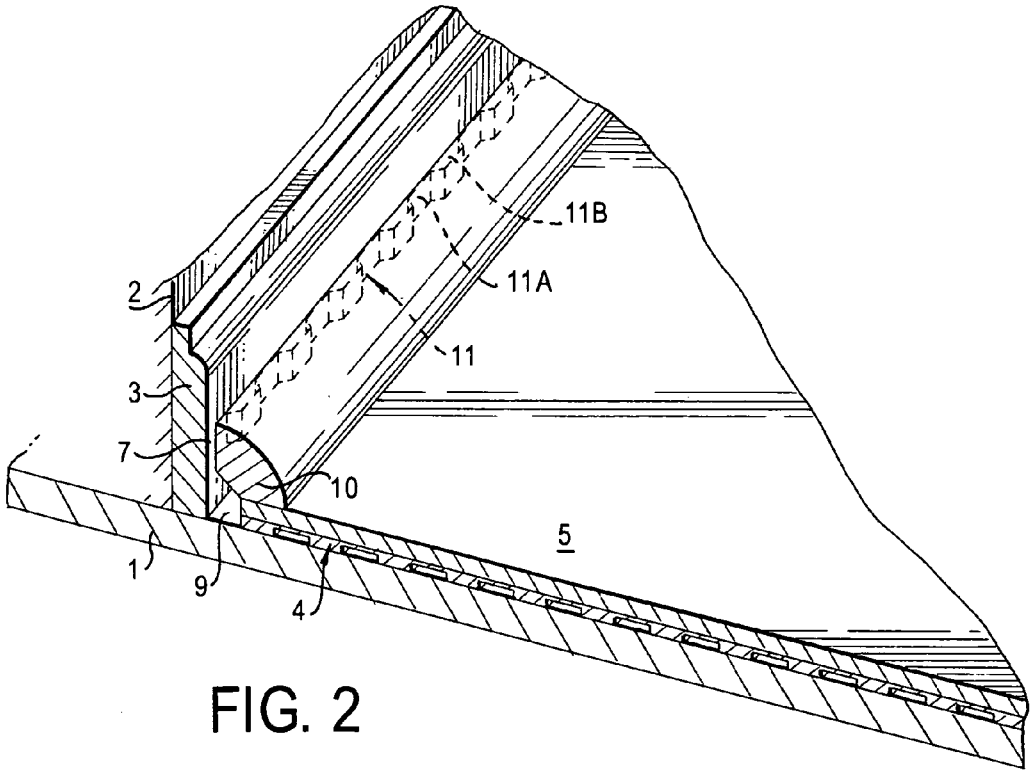
FIG. 2 is a perspective view of a second embodiment of a ventilated quarter round according to the invention in an installed condition.

It is also within the scope of the invention install the assembly of the invention without the spacing material 8. As shown in FIG. 2, a reverse face 11 of quarter round 6 can be provided with ducts 11A. The ducts 11A preferably extend across the entire height of reverse face 11, e.g., in a straight parallel configuration, to allow for the passage of air and vapor to escape therethrough. Although not preferred, it is additionally within the scope of the invention to form ducts 11A in a crisscross or grid-type pattern to allow directed air to flow in directions other than straight up.

When quarter round 6 is formed from a material which can absorb water, the ducts 11A may be coated with a material to prevent such absorption. This material can be a physical sealant, such as paint, or a layer of plastic, or simply a coating, such as wax (such as paraffin), which can reduce or eliminate the passage of water vapor therethrough. If, however, the quarter round 6 is formed from a non-absorbing material, e.g., plastic or metal, such a material is not necessary.

Preferably, ducts 11A terminate, at an upper end at ports 11B. Such ports 11B are preferably regularly spaced across a longitudinal length of quarter round 6. Such a configuration can result in a more aesthetically pleasing surface. Typically, ports 11B can be spaced with about ¼ in. (6.35 mm), about ½ in. (12.7 mm), about 1 in. (25.4 mm), about 2 in. (50.8 mm), and 3 in. (76.2 mm) between. Typically, ports 11B all have the same width and depths, which widths can be about ⅛ in. (3.15 mm), about ¼ in. (6.35 mm), about ½ in. (12.7 mm), and about 1 in. (25.4 mm), and which depths are typically are about ⅛ in. (3.15 mm) or about ¼ in. (6.35 mm).

Figure 3:
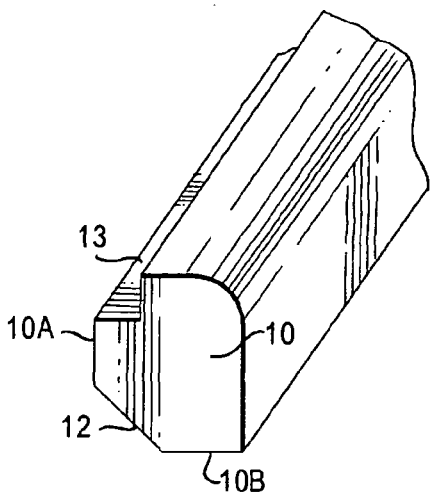
FIGS. 3 and 4 are views of shoe moldings in accordance with the invention.
Figure 4:
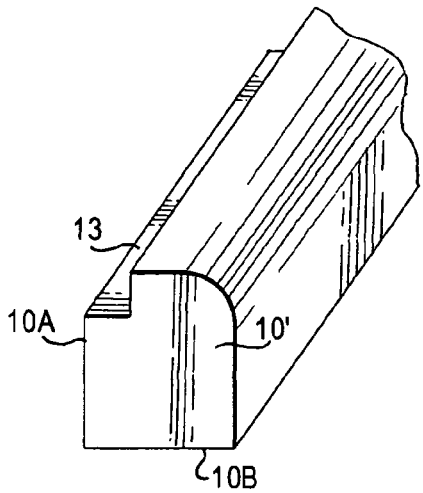

Although described as being a quarter round molding, the invention can be used with other types of moldings to hide joints between floors and walls. For example, FIGS. 3 and 4 show shoe moldings 10 and 10' which can be used as a substitute for quarter round 6. As is known in the art, shoe moldings are similar to quarter round moldings, but have a substantially rounded upper segment (adjacent to the wall when installed) and a substantially straight lower segment (adjacent to the floor when installed). While a rear face 10A and a bottom face 10B meet at a substantially right angle of the shoe molding 10', rear face 10A and bottom face 10B are bridged by a relief cut 12 in shoe molding 10. The relief cut 12 (which can also be provided on a quarter round molding) can be used to increase the size of space 9 which can increase the dissipation of water vapor, with or without spacing material 8. Other than the inclusion of the relief cut 12, the shoe moldings 10 and 10' are substantially identical, and other than the shape of the exposed surface quarter round 6 is substantially identical to shoe molding 10. Therefore, when less than each of quarter round 6, shoe molding 10 and shoe molding 10' is discussed, unless specified, such discussion should be understood to apply to each other molding as described herein.

The shoe moldings 10 can also be provided with a depression 13 which can run the entire length of the shoe molding 10 to assist in dissipation of water vapor and to additionally increase the aesthetics of the shoe molding 10, by, for example, providing a "shadow effect." Such depression can be substantially straight or can vary in its size and shape, e.g., have a sinusoidal, square wave, stepped, bell-curve or any other regular or irregular pattern along the length.

Figure 5:
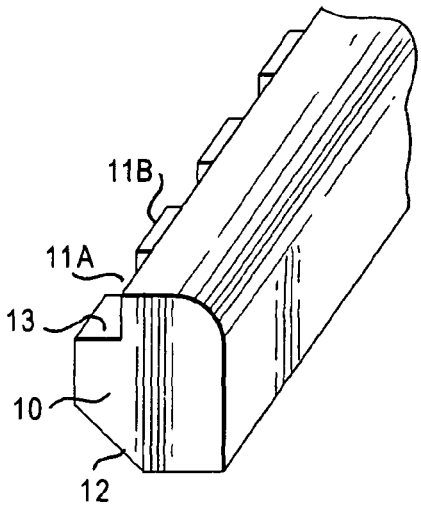
FIGS. 5 and 6 show alternative shoe moldings of the invention.
Figure 6:
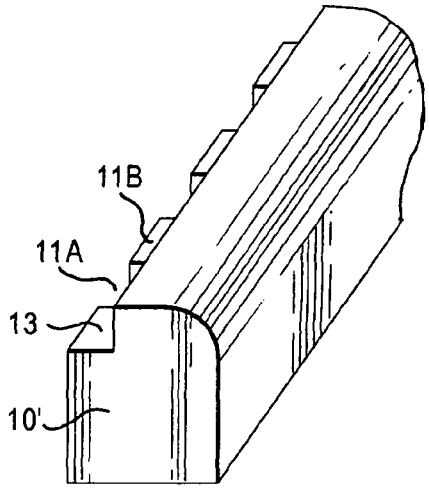

Depression 13 can also be integrated with ducts 11A and ports 11B, allowing air and water vapor to more easily move from the underside of layer 4 to space above shoe molding 10. As shown in FIGS. 5 and 6, the ducts 11A can have straight, substantially parallel, sides which ports 11B at a base of the depression 13. Alternatively, the ducts 11A can have other shapes, e.g., with angled sides (either converging or diverging) or curved sides.

Figure 7:
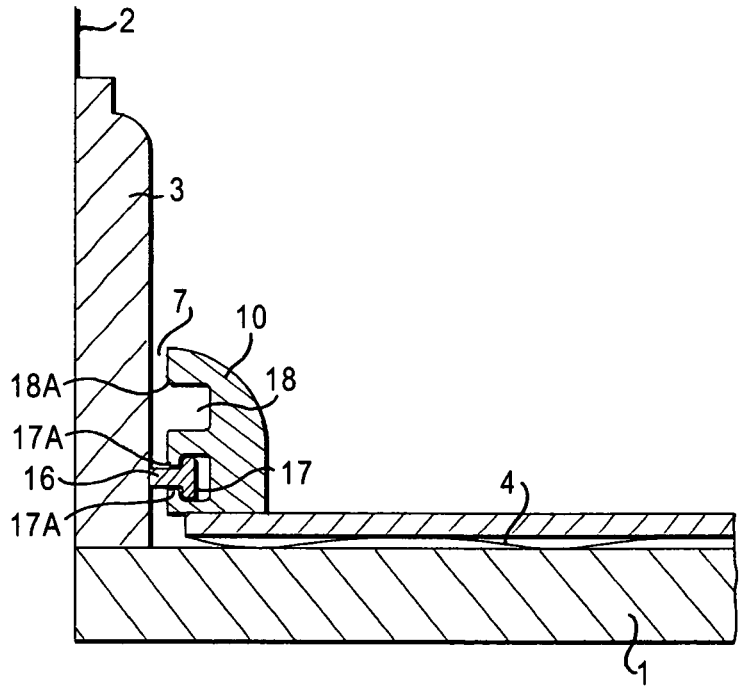
FIG. 7 is a side view of an additional embodiment of the moldings of the invention.

Although the shoe molding 10 can be joined to the wall 2 or wall base 3 by methods/materials such as glues/adhesives (e.g., fresh and pre-applied), and conventional mechanical fasteners (e.g., nails, screws, and tacks), the shoe molding 10 can be joined with a joining element 16. Such joining element is typically affixed to wall 2 or wall base 3 (by methods/materials such as glues (e.g., fresh and pre-applied), and conventional mechanical fasteners (e.g., nails, screws, and tacks)), and holds shoe molding 10 in its installed position by a tongue and groove joint (FIG. 7). Typical joining elements 16 include those described by WO 2005/116364, herein incorporated by reference in its entirety.

In one embodiment, the shoe molding 10 has a groove or opening 17, preferably having locking edges 17A, sized and shaped to receive a tongue or enlarged portion of the joining element 16.

However, it is within the scope of the invention to relatively "flip" the location of the tongue and groove, by for example, positioning joining element 16 on the hidden face of shoe molding 10, and providing wall 2 or wall base 3 with a groove. The joining element 16 can be attached along the entire length of the wall 2 or wall base 3, or at intervals sufficient to secure the shoe molding 10.

The tongue-groove configuration allows the shoe molding 10 to be snapped against the wall base 3. Typically, the tongue can be bulbous, dove-tailed, half dove-tailed, or straight, with the groove being complimentarily shaped. The joining element 16 and the shoe molding 10 can be joined by snapping the tongue into the groove, such as by any combination of (1) relative horizontal motion in a plane perpendicular or parallel to the axis of the shoe molding 10, (2) relative vertical motion in a plane perpendicular or horizontal to the axis of the shoe molding 10, and (3) relatively rotating the shoe molding 10 in a plane perpendicular to the axis of the shoe molding 10. Optionally, the shoe molding 10 is provided with at least one opening 18, which can also have locking elements 18A to allow for different height configurations for the shoe molding 10, or for additional forces to maintain the shoe molding 10 in place when the joining element has a equal number of tongues. Such opening 18 may also be used as a raceway to house elements, such as wiring (e.g., electrical and audio/visual/telephone), heating elements (e.g., electrical or radiant) and plumbing.

With reference to FIG. 9, an alternate wall base 103, including an integral quarter round 103A. Optionally, the wall base 103 can include an extension 103B, designed to continue below the quarter round 103A. Formed between the flooring element 5 and the wall base 103 is a space 103C allowing water vapor to be ventilated from beneath the flooring element 5.

Additionally, the invention can be used with an unattached, preferably foam, underlayment 22, alone or in combination with a flat polymeric (preferably polyethylene) sheet, i.e., without the channels 4A. Thus, the invention can be utilized with a ventilated or unventilated underlayment.

Figure 10:
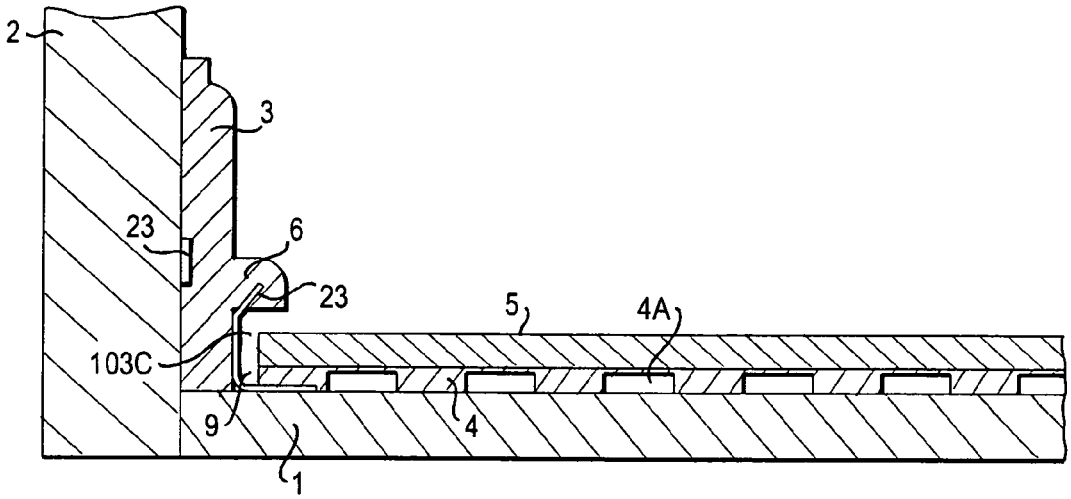

Although the moldings of the invention can be joined to the wall 2 by direct mechanical or chemical methods, e.g., nails, screws, and/or glue, one or more clips 23 can be used (FIG. 10). Suitable clips are known in the art, and in addition to the clip shown in FIGS. 10 and 10A, suitable clips include those as described by U.S. Pat. No. 6,287,046 and WO 2005/116364, each of which is incorporated by reference in its entirety. For example, a suitable clip 23 can include a number of flexible barbs, sized and shaped to mate with a groove structure on the molding to hold the molding along the wall. Such clips 23 may also include a space to permit wires or small pipes to pass therethrough.

Figure 8:
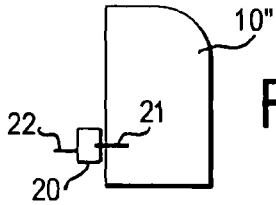
FIG. 8 shows an alternative shoe molding of the invention.

The invention additionally includes an apparatus and method for converting traditional shoe moldings into ventilated shoe moldings 10". As shown in FIG. 8, a separator or shim 20 can be affixed to the hidden face of the shoe molding 10" such that when the shoe molding 10" is affixed to the wall 2 or wall base 3, the spaces around shim 20 form the ducts 11A, acting as a pathway to dissipate the water vapor. The shim 20 is preferably affixed to each of the shoe molding 10" and wall 2 or wall base 3 by connectors 22, each of which independently can be any combination of glues/adhesives (e.g., fresh and pre-applied), and conventional mechanical fasteners (e.g., nails, screws, and tacks).

Figure 11:
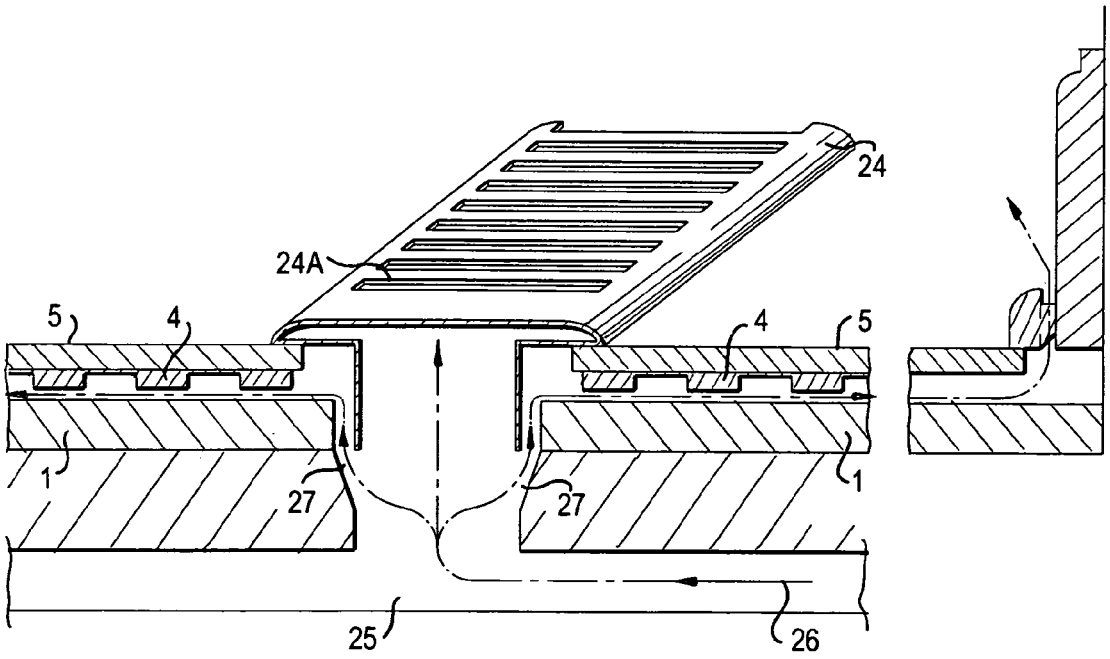
FIG. 11 is a view of a ventilated molding for use at a location other than a wall-floor corner.

FIG. 11 demonstrates an alternative embodiment, utilizing a forced air disperser 24, having vent holes therein 24A. The disperser 24 allows some of the air that is circulated in a forced air heating/cooling system to pass beneath the flooring elements 5 and escape, not only through the disperser 24, but also through the ventilated moldings of the invention. In one embodiment, the disperser 24 can be used with a forced air plenum 25, which directs treated air in the direction shown by arrow 26. Ducts 27 are typically in fluid communication with a forced air system 28 (not shown) and the disperser 24, to allow for the treated air to pass from the system 28 out through the disperser 24. In addition to using forced air from the system 28, a small blower 29 (not shown) may be attached to a separate plenum beneath the finished floating floor, allowing this forced air to escape through the disperser 24. The blower 29 may also be configured to include a heating/cooling system, such as a chemical and/or thermoelectric device, such that no external heating/cooling apparatus is necessary.

The disperser 24 is preferably designed to match the flooring elements. Thus, the disperser 24 can be made from any of the above-identified materials. For example, the disperser 24 can have an upper decorative surface including a foil, sheet or other metal, laminate, paint, print, or other abrasion resistant surface, which decorative surface is positioned on a core, made from, for example, metal, cellulosic materials (such as fiberboard, cork, particleboard, strandboard, etc.), plastic or composite material.

The invention additionally includes packaging to be used by, for example, wholesalers or retailers. In one embodiment, multiple individual pieces, such as shoe molding 10, may be bundled in a single package or kit. In another embodiment, the package or kit includes two, or three, or even up to twenty or more, of each piece packaged therein, which can be all the same or of various different lengths. For example, a single package may include three approximately one-meter (or three foot) sections of each item contained therein, for a total length of about three meters (about nine feet). It is additionally within the scope of the invention to include different sets of items in a single package, for example, one set being about one meter (about three feet) long and an additional set being about two meters (about six feet) long, i.e., 1:2. In one particular embodiment, where three different lengths are included (either of the same or different products), the materials contained in the package have length ratios of 1:2:3 to allow for easy assemblage of the package.

A typical kit in accordance with the invention includes the ventilated molding and other ventilated or conventional pieces. The other pieces can be, e.g., the underlayment, barrier layer, shim, clip, disperser, nail(s), wall base, or glue. A preferable kit includes the ventilated quarter round molding and a wall base, the wall base having a décor which matches a décor of the ventilated quarter round molding.

It should be apparent that embodiments other than those specifically described above may come within the spirit and scope of the present invention. Hence, the present invention is not limited by the above description.

We claim:

1. An assembled molding system comprising:

a molding comprising an outer decorative surface and a rear surface, the rear surface defining a plurality of air and water vapor conveying ducts therein, and an underlayment providing air and water vapor communication with the plurality of the air and water vapor conveying ducts of the molding, where the underlayment is provided between a subfloor and at least one flooring element positioned over said underlayment, and the molding is placed above the at least one floor element with its air and water vapor conveying ducts in air and water vapor communication with the air and water vapor conveying ducts of the underlayment;

wherein said molding is selected from the group consisting of a wall base molding, a quarter round molding and a shoe molding, wherein the molding is attached to a structure by means of a clip, wherein said structure is selected from the group consisting of a wall and a wall base molding.

2. An assembled molding system comprising:

a molding comprising an outer decorative surface and a rear surface, the rear surface defining a plurality of air and water vapor conveying ducts therein, and an underlayment providing air and water vapor communication with the plurality of the air and water vapor conveying ducts of the molding, where the underlayment is provided between a subfloor and at least one flooring element positioned over said underlayment, and the molding is placed above the at least one floor element with its air and water vapor conveying ducts in air and water vapor communication with the air and water vapor conveying ducts of the underlayment; wherein the molding is a quarter round molding and is positioned adjacent a wall or wall base such that the ducts permit ventilation of water vapor from below the molding to escape.

3. The assembled molding system of claim 1, wherein the underlayment comprises a barrier layer having channels defined therein.

4. The assembled molding system of claim 3, wherein the channels are defined by bosses.

5. The assembled molding system of claim 1, further comprising a spacing material positioned in the ducts.

6. The assembled molding system of claim 5, wherein the spacing material comprises physical spaces therein or absorbs water vapor.

7. The assembled molding system of claim 1, wherein the ducts are coated with a material which hinders water absorption.

8. The assembled molding system of claim 1, further comprising a longitudinal depression in fluid communication with a plurality of the ducts.

9. The assembled molding system of claim 1, wherein the outer decorative surface is at least one selected from the group consisting of laminate, liquid coating, wood veneer, foil, polyesters, paints, vinyls, liquid coatings and metals.

10. An assembly comprising:

a floor, positioned above a subfloor;

a wall, positioned adjacent the floor; and the assembled molding system of claim 1, connected to at least one of the floor and the wall.

11. The assembly of claim 10, wherein the assembly further comprises a barrier layer positioned between the subfloor and the floor.

12. The assembly of claim 11, wherein the barrier layer has channels therein, and the channels are in fluid communication with the ducts.

13. The assembly of claim 10, wherein the outer decorative surface of the molding is the same as a décor of at least one of the floor and the wall.

14. A structure comprising the assembly of claim 10, wherein the structure is selected from the group consisting of a home, shopping mall, restaurant, retail establishment, warehouse and office building.

* * * * *